US006265989B1

(12) United States Patent
Taylor

(10) Patent No.: US 6,265,989 B1
(45) Date of Patent: Jul. 24, 2001

(54) GPS ENABLED SPEEDING DETECTOR

(76) Inventor: Richard Taylor, 8402 N. Bristle Pine Dr., Spring, TX (US) 77379-6360

( * ) Notice: Subject to any disclaimer, the term of this patent is extended or adjusted under 35 U.S.C. 154(b) by 0 days.

(21) Appl. No.: 09/596,353

(22) Filed: Jun. 17, 2000

(51) Int. Cl.[7] ..... G08G 1/00

(52) U.S. Cl. ..... 340/901; 340/902; 340/905; 340/936; 340/539; 701/117

(58) Field of Search ..... 340/901, 902, 340/905, 904, 933, 936, 539, 825.06; 707/117

(56) References Cited

U.S. PATENT DOCUMENTS 6,163,277 * 12/2000 Gehlot ..... 340/905

* cited by examiner

*Primary Examiner*—Daryl Pope
(74) *Attorney, Agent, or Firm*—Clement Cheng

(57) ABSTRACT

This invention is a GPS speeding detector including a GPS receiver, a CPU, a database of speed limits for a particular geographical region, and speaker. The unit can be integrally mounted in a car or used as a stand-alone device. The CPU receives position data from the GPS receiver, uses the position to calculate the speed of the vehicle, and queries the speed limit on a database. The CPU compares the vehicle speed against the posted speed. An audio tone from the speaker notifies the driver of speeding.

12 Claims, 1 Drawing Sheet

GPS ENABLED SPEEDING DETECTOR

CROSS REFERENCES TO RELATED APPLICATIONS

Croyle U.S. Pat. No. 6,029,111 (701/207), issued Feb. 22, 2000

Kohli U.S. Pat. No. 6,041,280 (701/201), issued Mar. 21, 2000

Gildea U.S. Pat. No. 6,018,784 (710/129), issued Jan. 25, 2000

Andrews U.S. Pat. No. 5,983,156, (701/115) issued Nov. 9, 1999

Ross U.S. Pat. No. 5,977,884 (340/936) issued Nov. 2, 1999

Vaughn U.S. Pat. No. 5,485,161 (342/357) filed Nov. 21, 1994

BACKGROUND OF THE INVENTION

Traffic Tickets

Presently, the total number of traffic tickets issued is approximately 175 million per year, and the vast majority of these tickets are speeding tickets. By definition, every driver is forced to maintain a certain speed due to speed signs. Failure to stay at or below the posted speed may lead to a traffic ticket. Due to limited concentration, it is hard for a driver to know the proper speed limit of an area. Also, signs may be hard to see. Yet GPS offers a way to help drivers deal with speed limits.

Global Positioning Satellites (GPS) allows satellites in orbit around the earth to provide geographical position information to ground receivers.

Recent Advances in GPS

With recent advances, the GPS signal has become outstandingly accurate. The accuracy is enough locate a car on a road. Recently, many advances have allowed the signal of a GPS receiver to become much more accurate and low cost when placed in a vehicle. Croyle U.S. Pat. No. 6,029,111 (701/207), issued Feb. 22, 2000 discloses the use of GPS velocities to allow micro-machined piezoelectric sensors much better accuracy than ever before. Moreover, the position and speed can be further improved as shown in Kohli U.S. Pat. No. 6,041,280 (701/201), issued Mar. 21, 2000. By comparing position and direction changes with GPS signal changes, the position and speed of a car can be further determined.

The convenience of GPS is now at the consumer level. Stand-alone devices now retail for about $200 in stores. The GPS signal can be received from a personal computer as well. Gildea U.S. Pat. No. 6,018,784 (710/129), issued Jan. 25, 2000 allows a PCI card in a personal computer to accept a GPS signal. By combining the ease and accuracy of GPS, many new applications and functions are now available. Andrews U.S. Pat. No. 5,983,156, (701/115) issued Nov. 9, 1999 shows that GPS can automatically vary the performance of a car depending upon geography. Comparing a GPS position with a city map database can allow automatic control of the engine computer. This can change the engine fueling via the engine computer so that a car performs with low emissions in the city and with more power in the wilderness.

Use of GPS to Avoid Speeding

Speed Minder uses lights and tones to alert drivers that they are speeding. Haeri U.S. Pat. No. 5,659,290 (340/441) issued Aug. 19, 1997 shows that a speedometer or other drive shaft connection can measure speed and alert a driver if the vehicle is over a preset speed limit. Haeri U.S. Pat. No. 5,659,290 includes a digital display and tone to notify the driver.

Ross U.S. Pat. No. 5,977,884 (340/936) issued Nov. 2, 1999 activates a radar detector alarm if the radar detector detects radar or if the GPS signal shows speeding. A tachometer signal or a GPS receiver gives the vehicle's speed. This invention requires the user to manually set the speed limit.

Vaughn U.S. Pat. No. 5,485,161 (342/357) filed Nov. 21, 1994, allows vehicle speed control based on GPS/MAP matching of posted speeds. The system includes a GPS navigation receiver, a database processing facility, a GPS computer, an engine computer, a video display, a speed sensor and a heading sensor. The database processing facility can be local or remote. The GPS computer obtains the latitude, longitude, heading and speed of the vehicle. The database processing facility processes the GPS data and obtains the location and the maximum-posted speed of the vehicle. The GPS computer or an engine computer perform the comparison between the vehicle speed and the maximum posted speed and signal the odometer to decrease the vehicle speed if the vehicle speed exceeds the maximum posted speed plus some predetermined value.

SUMMARY OF THE INVENTION

This invention is a GPS speeding detector including a GPS receiver, a CPU, a database of speed limits for a particular geographical region, and speaker. The unit can be integrally mounted in a car or used as a stand-alone device. The CPU receives position data from the GPS receiver, uses the position to calculate the speed of the vehicle, and queries the speed limit on a database. The CPU compares the vehicle speed against the posted speed. An audio tone from the speaker notifies the driver of speeding.

BRIEF DESCRIPTION OF THE DRAWINGS

A detailed description of the embodiments of the invention will be made with reference to the accompanying drawings, wherein like numerals designate corresponding parts in figures.

DETAILED DESCRIPTION

Figure 1:
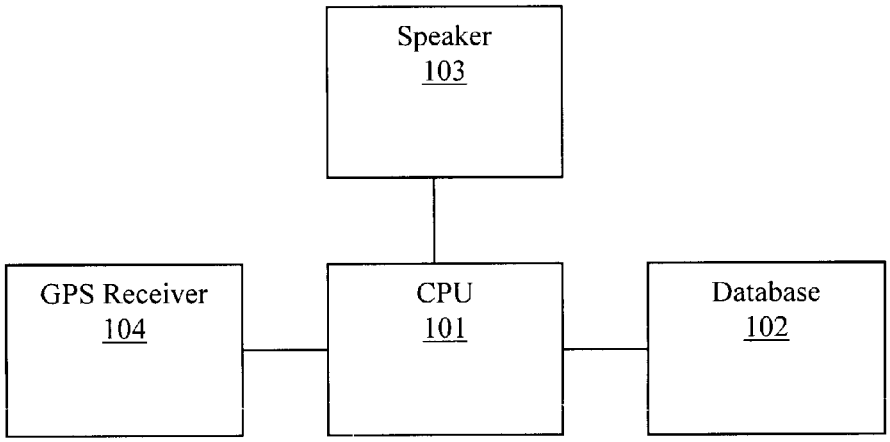
FIG. 1 is a Diagram of the GPS speeding detector.

The present invention also notifies a driver that he is speeding. A GPS signal is compared with a database on a DVD, laptop or CD-ROM to determine if the driver is speeding. The unit, as shown in FIG. 1., requires only a computer 101, a database 102, a speaker 103, and a GPS receiver 104.

The computer or CPU 101 can be a laptop or palmtop computer, such as ones commercially available. A GPS receiver 104 on a PCI card or other card could receive the GPS signals and software could compare the signal to a database 102 on a DVD disc. The advantage of using a fat client computer is to allow use of other applications to the driver or passengers. The computer could also be a custom made unit housing integrally the speaker, GPS receiver and database. The best mode is a thin client because the functionality of the CPU is limited to simple arithmetic.

The database 102 can be stored locally on a hard drive, CD or DVD ROM, flash memory or some other commercially available means. The preferred means to store the information is on a DVD. The database discs can be updated monthly or yearly or as traffic speeds limits change.

The speaker 103, element emits audio signals. OEM car speakers are adequate for this task, as are the small cheap speakers found at any electronics store. The GPS receiver 104, is also available commercially and merely requires the ability to receive the position of the car.

The GPS data is stored locally so that it does not need to be downloaded. Memory space in the form of hard drives, DVDs and CD-ROMs are relatively inexpensive. Thus, this invention is an improvement over old art that required a telephone or data connection.

The operation of the device begins at time increment one where the GPS receiver 104 sends a position signal to the CPU 101. The CPU 101 queries the database 102 and returns a legal speed limit to the CPU 101. The GPS receiver 104 sends a second position signal at time increment two to the CPU 101. The CPU 101 compares the two positions to calculate speed by taking the position difference (which is the distance traveled) and dividing it by the time increment.

The CPU 101 compares the vehicle speed with the legal speed limit. If the vehicle speed is greater than the posted speed limit, the CPU 101 sends an audio signal to activate the speaker 103 to alert the driver. If the vehicle speed is less than the posted speed limit, the CPU 101 waits for the next position signal from the GPS receiver 104. Just as the position signal at time increment one was compared with the position signal at time increment two, the position signal at time increment two is compared with the position signal at time increment three.

Figure 2:
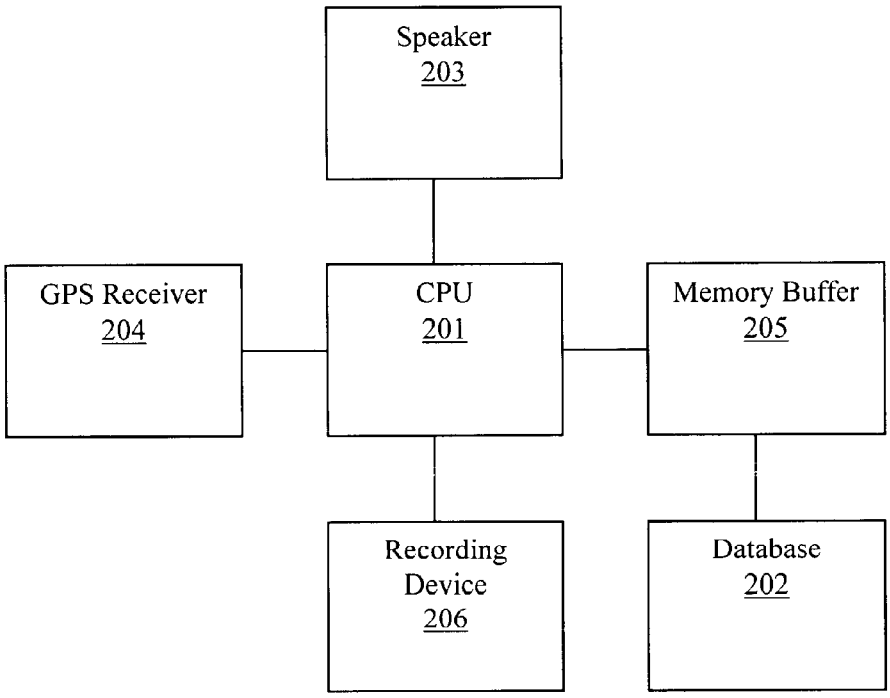
FIG. 2 is a Diagram of the GPS speeding detector including the memory buffer and recording device.

If the database uses a removable media disc, constant accessing of the disc can lead to premature mechanical failure. To prevent constant "disk banging", the preferred mode of implementation FIG. 2. is to read the intra second position changes from buffer memory 205 such as a RAM chip. Speed limits can be broken down into geographical areas. The geographical areas can correspond to zip codes, municipalities or some convenient geographical area. When a driver drives to a different part of town, the database disc uploads a new geographical area into the buffer memory 205. The buffer memory 205 can also serve as backup memory. In case of mechanical failure, the buffer memory 205 can retain sufficient legal speed limit data to prevent an immediate shutdown of the apparatus.

To further reduce the need for database accessing, the storage of the speed limits on the database can be simplified into speed zones. Instead of storing individual points, the database stores fields of information. The geographical area comprised of different speed zones can be uploaded into buffer memory 205. The advantage of a speed zone is that an audio tone can also notify the driver of upcoming zones having different speed limits. Having multiple distinct audio tones allows a driver to distinguish between driving slightly over the speed limit and driving 10 miles over the speed limit (where most traffic tickets are issued).

When the vehicle velocity is close to zero, the user can push a button to activate the parking database. After pushing a button on, the CPU queries the database for parking data. An audio tone can signal the driver regarding parking regulations. Here, the database contains a separate set of data for parking regulations. Thus, a driver when parking the car would hear one tone for no stopping, one tone for no parking, and a different tone for a 15 minute loading zone.

The computer can be adapted to write a permanent record of the speed, location and time of travel to provide evidence in court. The record in this case would be kept in a recording device 206. The recording device would simply be a database held on portable media such as a flash ROM card. The evidence would allow drivers to do everything from defend themselves in court to helping them prepare their mileage deductions for tax returns.

What is claimed is:

1. A GPS speeding alarm apparatus comprising:

a. a CPU, b. a database holding speed limit data, said database capable of sending speed limit data to said CPU, c. a GPS receiver capable of sending vehicle position data to said CPU, d. a speaker capable of emitting an audio tone when said CPU sends an audio signal to activate said speaker, wherein said CPU is capable of comparing speed limit data from said database with vehicle speeds derived from taking a time differential of said vehicle position data from said GPS receiver, and wherein said CPU can compare a current posted speed limit with vehicle speed, and wherein said CPU can send an audio signal to activate said speaker should vehicle speed exceed the current posted speed limit.

2. The invention of claim 1, further comprising:

e. a memory buffer having no moving parts, said a memory buffer connecting the CPU to the database, wherein the CPU reads data from said memory buffer, wherein said memory buffer reads data from said database, said memory buffer capable of receiving a batch of geographical data from the database when the vehicle enters a new geographic region.

3. The invention of claim 2, wherein said database further includes parking data sent to the CPU when the vehicle is stopped and a button is pushed, wherein the CPU compares the parking data with vehicle position data given by the GPS receiver, wherein the CPU sends an audio signal to the speaker contextually dependent upon parking data, whereby a driver can be notified of parking rules and regulations.

4. The invention of claim 1, further comprising:

h. a recording device, connected to the CPU allowing the CPU to write a history of data on a media in the recording device, said history of data being downloadable from the vehicle, whereby a driver given a speeding ticket can challenge the speeding ticket by presenting said history of data in court.

5. The invention of claim 4, further comprising:

f. a memory buffer having no moving parts, said a memory buffer connecting the CPU to the database, wherein the CPU reads data from said memory buffer, wherein said memory buffer reads data from said database, said memory buffer capable of receiving a batch of geographical data from the database when the vehicle enters a new geographic region.

6. The invention of claim 5, wherein said database further includes parking data sent to the CPU when the vehicle is stopped and a button is pushed, wherein the CPU compares the parking data with vehicle position data given by the GPS receiver, wherein the CPU sends an audio signal to the speaker contextually dependent upon parking data, whereby a driver can be notified of parking rules and regulations.

7. A GPS speeding alarm method comprising the steps of:

a. storing speed limit data in a database, and transmitting said speed limit data to the CPU at regular time intervals, b. configuring a CPU to receive vehicle position data from a GPS receiver at time increment one, c. configuring a CPU to receive speed limit data from a database at time increment one, d. configuring a CPU to obtain the speed of the vehicle at time increment one by comparing vehicle position data at time increment one with the vehicle position data of the prior time increment, e. configuring a CPU to compare the speed limit data taken at time increment one with the posted legal speed limit to determine whether the vehicle is speeding, f. playing an audio tone when the vehicle is speeding, wherein an audio tone is emitted from a speaker when said CPU sends an audio signal to activate said speaker.

8. The invention of claim 7, further comprising the step of:

g. sending data from the database first to a memory buffer before said data reaches the CPU, wherein said memory buffer reads data from said database, said memory buffer capable of receiving a batch of geographical data from the database when the vehicle enters a new geographic region, wherein said memory buffer having no moving parts connects the CPU to the database.

9. The invention of claim 8, further comprising:

i. recording a history of data with a recording device, said recording device connected to the CPU allowing the CPU to write a history of data on a media in the recording device, said history of data being downloadable from the vehicle, whereby a driver given a speeding ticket can challenge the speeding ticket by presenting said history of data in court.

10. The invention of claim 9, wherein said database further includes parking data sent to the CPU when the vehicle is stopped and a button is pushed, wherein the CPU compares the parking data with vehicle position data given by the GPS receiver, wherein the CPU sends an audio signal to the speaker contextually dependent upon parking data, whereby a driver can be notified of parking rules and regulations.

11. The invention of claim 7, further comprising:

j. recording a history of data with a recording device, said recording device connected to the CPU allowing the CPU to write a history of data on a media in the recording device, said history of data being downloadable from the vehicle, whereby a driver given a speeding ticket can challenge the speeding ticket by presenting said history of data in court.

12. The invention of claim 11, wherein said database further includes parking data sent to the CPU when the vehicle is stopped and a button is pushed, wherein the CPU compares the parking data with vehicle position data given by the GPS receiver, wherein the CPU sends an audio signal to the speaker contextually dependent upon parking data, whereby a driver can be notified of parking rules and regulations.

* * * * *